US007885558B2

(12) United States Patent
Mori

(10) Patent No.: US 7,885,558 B2
(45) Date of Patent: Feb. 8, 2011

(54) IMAGE-FORMING DEVICE PREVENTING ADVERSE EFFECTS ON IMAGE FORMATION AND ON DETECTION OF OPTICAL SENSOR

(75) Inventor: Hirotaka Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 784 days.

(21) Appl. No.: 11/839,070

(22) Filed: Aug. 15, 2007

(65) Prior Publication Data

US 2008/0044193 A1 Feb. 21, 2008

(30) Foreign Application Priority Data

Aug. 17, 2006 (JP) ..... 2006-222494

(51) Int. Cl.
*G03G 15/00* (2006.01)

(52) U.S. Cl. ..... 399/49; 399/90; 399/121; 399/302; 399/308

(58) Field of Classification Search ..... 399/49, 399/90, 121, 302, 308
See application file for complete search history.

(56) References Cited

U.S. PATENT DOCUMENTS 6,226,486 B1 * 5/2001 Itou et al. ..... 399/303
2003/0215269 A1 * 11/2003 Kayahara et al. ..... 399/297

FOREIGN PATENT DOCUMENTS

JP 2001-183916 7/2001

* cited by examiner

*Primary Examiner*—Ryan D Walsh
(74) *Attorney, Agent, or Firm*—Banner & Witcoff, Ltd

(57) ABSTRACT

An image-forming device includes a photosensitive drum, a conveying unit, a transferring roller, an optical sensor, a ground connector. The photosensitive drum carries a developer image. The conveying unit includes a driving roller, and an endless belt. The endless belt is disposed in confrontation with the photosensitive drum and transferring roller. The optical sensor is disposed near the driving roller and detects the developer image on the endless belt. The first connection member has a first electrical resistance and is connected between the driving roller and a ground connector electrically grounded. The second connection member has a second electrical resistance and is connected between the endless belt and ground connector. The first electrical resistance is less than the second electrical resistance so that an electrical charge is quickly removed from the driving roller and more gradually removed from the endless belt, thereby simultaneously preventing adverse effects on image formation and adverse effects on the optical sensor disposed near the driving roller.

26 Claims, 10 Drawing Sheets

IMAGE-FORMING DEVICE PREVENTING ADVERSE EFFECTS ON IMAGE FORMATION AND ON DETECTION OF OPTICAL SENSOR

CROSS REFERENCE TO RELATED APPLICATION

This application claims priority from Japanese Patent Application No. 2006-222494 filed Aug. 17, 2006. The entire content of its priority application is incorporated herein by reference.

BACKGROUND OF THE INVENTION

1. Field of the Invention

The present invention relates to an electrophotographic image-forming device.

2. Description of the Related Art

One type of conventional electrophotographic image-forming device, such as that disclosed in Japanese unexamined patent application publication No. 2001-183916, has an intermediate transfer belt interposed between photosensitive drums and primary transfer rollers and between a conveyed sheet of recording paper and a secondary transfer roller. After applying a voltage to the primary transfer rollers disposed opposite the photosensitive drums to transfer developer images from the photosensitive drums onto the intermediate transfer belt, the image-forming device applies a voltage to the secondary transfer roller disposed opposite the recording paper to transfer the developer images carried on the intermediate transfer belt to the recording paper, forming an image on the recording paper.

Since a high voltage (transfer bias) is applied to the primary and secondary transfer rollers during the transfer operation, the belt unit, including the intermediate transfer belt, a drive roller for driving the belt, and the like, has a tendency to retain an electric charge. Therefore, the invention disclosed in Japanese unexamined patent application publication No. 2001-183916 grounds the belt unit through an electric-resistive material, such as varistors or resistors, to neutralize the belt, drive roller, and other members targeted for neutralization.

In recent years, image-forming devices have been provided with an optical sensor near the drive roller, which stabilizes the behavior of the belt. The image-forming device reads the density and the like of a resist pattern formed on the belt or developer deposited on the belt and controls operations based on this data.

However, since the drive roller is affected by the transfer bias and carries a high voltage charge, there is a high possibility that the optical sensor disposed near the drive roller will be greatly affected by the high voltage carried on the drive roller. Since the optical sensor cannot accurately detect data when strongly affected by such a high-voltage charge, the data detected by the optical sensor may adversely affect the control of the image-forming device.

Although the charge retained by the belt unit can be quickly removed by grounding the belt unit directly rather than through an electric-resistive material, it is difficult to transfer developer images with stability when the charge is removed too quickly from the belt, running a high risk of not being able to form images with stability.

An image-forming device having a direct tandem system for transferring developer images formed on photosensitive drums directly to a sheet of recording paper rather than through an intermediate transfer belt also has transfer rollers disposed on the side of the conveying belt opposite the photosensitive drums. Hence, an optical sensor disposed near the drive roller driving the conveying belt in such a direct tandem type image-forming device is also greatly affected by the high-voltage charge in the drive roller, and cannot accurately detect data.

SUMMARY OF THE INVENTION

In view of the foregoing, it is an object of the present invention to provide an image-forming device capable of preventing adverse effects on image formation, while preventing adverse effects on an optical sensor disposed near the drive roller.

The above and other objects will be attained by an image-forming device that includes a housing, an image-carrying member, a conveying unit, a transferring unit, an optical sensor, a ground connector, a first connection member and a second connection member. The image-carrying member carries a developer image. The conveying unit includes a driving roller rotatable about its rotation shaft, a tension roller disposed in spaced-apart relation with the driving roller, and an endless belt. The endless belt is supported between the driving roller and the tension roller and moved circularly by the driving roller. The endless belt has an area in confrontation with the image-carrying member and conveys a recording sheet placed on the endless belt. The transferring unit is disposed in confrontation with the image-carrying member with the area of the endless belt interposed therebetween. The transferring unit is configured to transfer the developer image on the image-carrying member to the endless belt in a first mode and to the recording sheet placed on the endless belt in a second mode. The optical sensor is disposed near the driving roller and operable in the first mode to detect the developer image on the endless belt. The ground connector is electrically grounded. The first connection member has a first electrical resistance and is connected between the driving roller and the ground connector to allow electrical charges to flow therebetween. The second connection member has a second electrical resistance and is connected between the endless belt and ground connector to allow electrical charges to flow therebetween. The first electrical resistance is less than the second electrical resistance.

As is clear from the above description, "near the driving roller" is the range from the driving roller in which the optical sensor is adversely affected by a charge retained in the driving roller.

In the construction described above, an electrical charge is quickly removed from the driving roller and more gradually removed from the endless belt, thereby simultaneously preventing adverse effects on image formation and adverse effects on the optical sensor disposed near the driving roller.

The problem described above may also be resolved by an image-forming device including a housing, an image-carrying member, a conveying unit, a transferring unit, an optical sensor, a cleaning unit, a ground connector, a first connection member and a second connection member. The image-carrying member carries a developer image. The conveying unit includes a driving roller rotatable about its rotation shaft, a tension roller disposed in spaced-apart relation with the driving roller, and an endless belt. The endless belt is supported between the driving roller and the tension roller and moved circularly by the driving roller. The endless belt has an area in confrontation with the image-carrying member and conveys a recording sheet placed on the endless belt. The transferring unit is disposed in confrontation with the image-carrying member with the area of the endless belt interposed therebetween. The transferring unit is configured to transfer the developer image on the image-carrying member to the endless belt in a first mode and to the recording sheet placed on the endless belt in a second mode. The optical sensor is disposed near the driving roller and operable in the first mode to detect the developer image on the endless belt. The cleaning unit includes a cleaning roller that removes the developer on the endless belt, and a backup roller in peripheral contact with the cleaning roller. The ground connector is electrically grounded. The first connection member has a first electrical resistance and is connected between the driving roller and the ground connector to allow electrical charges to flow therebetween. The second connection member has a second electrical resistance and is connected between the ground connector and at least one selected from a group consisting of the endless belt, the tension roller, and the backup roller, to allow electrical charges to flow therebetween. The first electrical resistance is less than the second electrical resistance.

In the construction described above, an electrical charge is quickly removed from the driving roller and more gradually removed from at least one selected from a group consisting of the endless belt, the tension roller, and the backup roller, thereby simultaneously preventing adverse effects on image formation and adverse effects on the optical sensor disposed near the driving roller.

DESCRIPTION OF THE PREFERRED EMBODIMENTS

An electrophotographic image-forming device according to an embodiment of the invention will be described while referring to the accompanying drawings.

Figure 1:
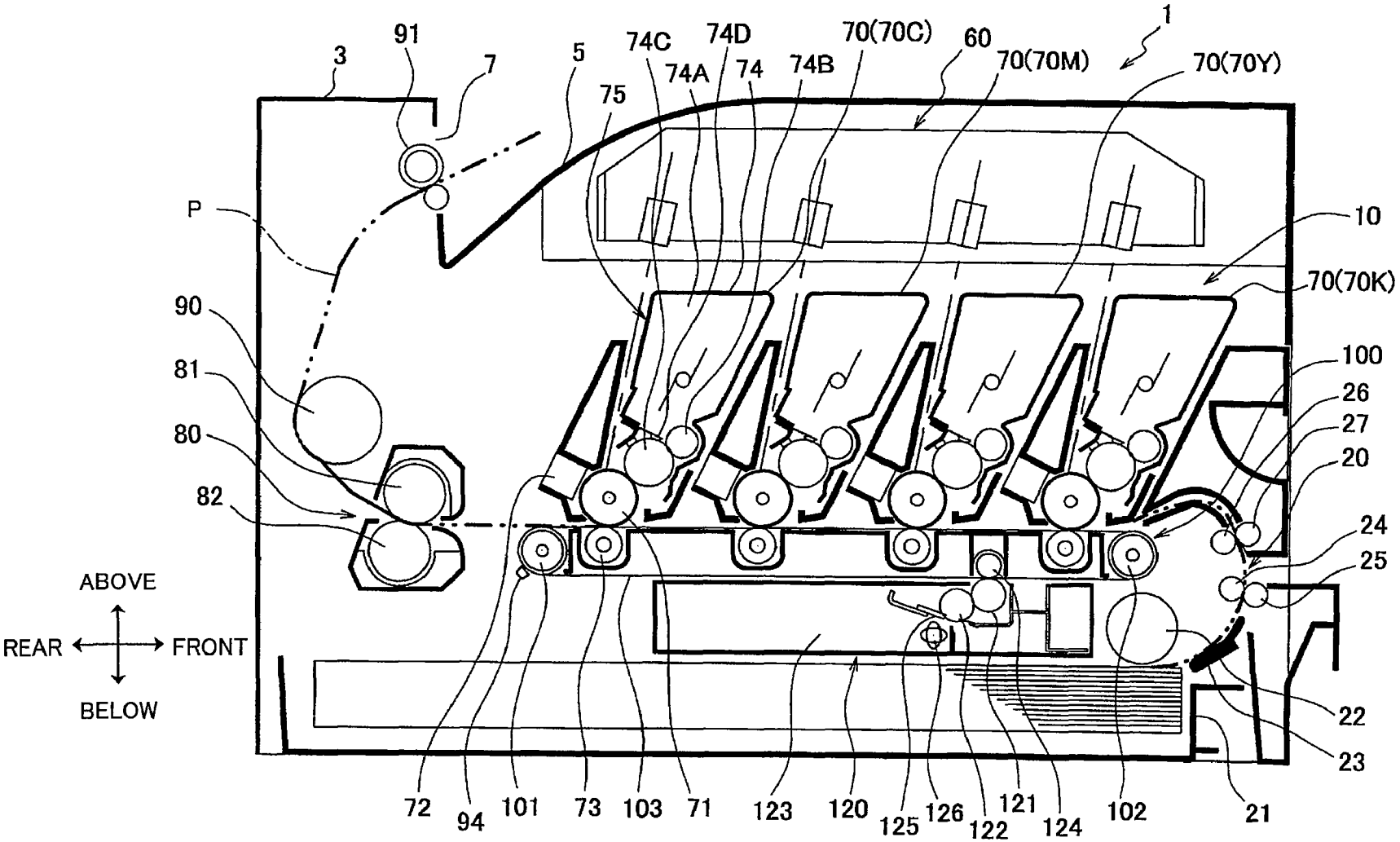
FIG. 1 is a side cross-sectional view showing the structure of a laser printer according to a first embodiment of the present invention.

In this embodiment, the electrophotographic image-forming device of the invention is applied to a laser printer 1 shown in FIG. 1. Note that in the following description, the expressions "front," "rear," "above," "below," and "beneath" are used to define the various parts when the laser printer 1 is disposed in an orientation in which it is intended to be used.

As shown in FIG. 1, the laser printer 1 includes a substantially box-shaped (cubic) housing 3. A discharge tray 5 is formed on the top surface of the housing 3 for receiving a recording sheet, such as paper sheet or OHP sheet, discharged out of the housing 3 after images have been printed thereon.

A frame member (not shown) formed of a metal or resin material or the like is disposed inside the housing 3. A feeding unit 20, an image-forming unit 10, a discharge roller 91, and the like are built into the frame member.

The feeding unit 20 includes a paper tray 21, a feeding roller 22, a separating pad 23, a conveying roller 24, pinch rollers 25 and 27, and a registration roller 26. The paper tray 21 is accommodated in the bottommost section of the housing 3. The feeding roller 22 is disposed above the front end of the paper tray 21 for supplying sheets of paper loaded in the paper tray 21 to the image-forming unit 10. The separating pad 23 applies a prescribed conveying resistance to the paper so that the feeding roller 22 feeds one sheet of paper at a time.

The conveying roller 24 conveys sheets of paper supplied from the paper tray 21 to the image-forming unit 10. The pinch roller 25 is disposed in opposition to the conveying roller 24 for pressing the paper against the conveying roller 24. The registration roller 26 corrects skew in paper conveyed by the conveying roller 24 and for further conveying the paper toward the image-forming unit 10, and the pinch roller 27 disposed in opposition to the registration roller 26. A coil spring (not shown) is provided for pressing the pinch roller 25 against the conveying roller 24. Similarly, a coil spring (not shown) is provided for pressing the pinch roller 27 against the registration roller 26.

The image-forming unit 10 includes a scanner unit 60, a fixing unit 80, a belt unit 100, a cleaning unit 120, and a photosensitive unit 70 including four photosensitive drums 71.

The scanner unit 60 is disposed in the upper section of the housing 3 for forming an electrostatic latent image on the surface of each of the photosensitive drums 71. Although not shown in the drawings, the scanner unit 60 includes laser emitting sections, polygon mirrors, fθ lenses, and reflecting mirrors.

Each laser emitting section emits a laser beam based on desired image data. The laser beam is reflected by the polygon mirror, passes through the fθ lens, is reflected by the reflecting mirror, and is reflected downward by the reflecting mirror so as to irradiate the surface of the photosensitive drum 71, thereby forming an electrostatic latent image thereon.

The photosensitive unit 70 includes a photosensitive-unit casing 75 and four developer cartridges 70K, 70Y, 70M, and 70C that correspond each color of the developer (Black, Yellow, Magenta, and Cyan). Since the four developer cartridges 70K, 70Y, 70M, and 70C have the same structure, differing only in the color of developer used, the developer cartridges 70K, 70Y, 70M, and 70C will be collectively referred to as the developer cartridges 70.

The developer cartridges 70 are detachably provided in the housing 3 beneath the scanning unit 60. Each developer cartridge 70 is configured of a casing 75 accommodating a developer-accommodating section 74.

The developer-accommodating section 74 includes a developer-accommodating chamber 74A, a supply roller 74B and a developing roller 74C for supplying developer to the respective photosensitive drum 71, and a thickness-regulating blade 74D. The supply roller 74B rotates to supply developer from the developer-accommodating chamber 74A toward the developing roller 74C. Developer supplied onto the developing roller 74C is carried on the surface of the developing roller 74C, while the thickness-regulating blade 74D regulates the thickness of the developer to a uniform prescribed thickness.

Subsequently, the developing roller 74C supplies the developer to the surface of the photosensitive drum 71 exposed by the scanning unit 60.

The photosensitive drums 71 function to carry images to be transferred onto an endless conveying belt 103 in a test mode or paper placed on the conveying belt 103 in a print mode. Each photosensitive drum 71 is configured in a cylindrical shape, the outermost layer of which is coated with a positive-charging photosensitive layer formed of polycarbonate.

The charger 72 is disposed in opposition to the photosensitive drum 71 at a position diagonally above and rearward of the same and is separated from the photosensitive drum 71 by a prescribed distance. The charger 72 is a Scorotron charger having a charging wire formed of tungsten. The charging wire generates a corona discharge for charging the surface of the photosensitive drum 71 with a uniform positive polarity.

As the photosensitive drum 71 rotates, the charger 72 charges the surface of the photosensitive drum 71 with a uniform positive polarity. Subsequently, the scanning unit 60 irradiates a laser beam onto the photosensitive drum 71 in a high-speed scan, thereby forming an electrostatic latent image on the surface of the photosensitive drum 71 corresponding to an image to be formed on an area of the conveying belt 103 or paper placed on the conveying belt 103.

Next, as the developing roller 74C rotates, the positively charged developer carried on the developing roller 74C comes into contact with the respective photosensitive drum 71. At this time, the developer is supplied to the electrostatic latent image formed on the surface of the photosensitive drum 71, i.e. regions of the uniformly charged photosensitive drum 71 that have been exposed by the laser beam and, therefore, have a lower potential. The supplied developer develops the electrostatic latent image into a visible image according to a reverse development process so that a developer image is carried on the surface of the photosensitive drum 71.

While described in greater detail below, the belt unit 100 is positioned between the feeding unit 20 and the fixing unit 80 and functions to convey paper. Developer images carried on the surfaces of the photosensitive drums 71 are transferred onto the paper conveyed on the belt unit 100 by a transfer bias applied to transferring rollers 73 (described later), which are provided in the belt unit 100. After images are transferred onto the conveying belt 103 or paper placed on the conveying belt 103, the belt unit 100 conveys the paper to the fixing unit 80.

The fixing unit 80 is disposed on the downstream side of the photosensitive drums 71 with respect to the sheet conveying direction. The fixing unit 80 is for thermally fixing the developer transferred onto the recording sheet, and is detachably mounted in the housing 3.

Specifically, the fixing unit 80 includes a heat roller 81 and a pressure roller 82. The heating unit 81 is disposed on the printing surface side of the recording sheet and applies conveying force to the recording sheet while heating developer clinging on the recording sheet. The pressure roller 82 is disposed in confrontation with the heat roller 81 and presses a recording sheet interposed between the pressure roller 82 and the heat roller 81 against the heat roller 81.

When the paper is conveyed to the fixing unit 80, the fixing unit 80 generates heat for fixing the transferred developer images to the paper, thereby completing image formation.

Next, the belt unit 100 will be described further in detail.

Figure 2:
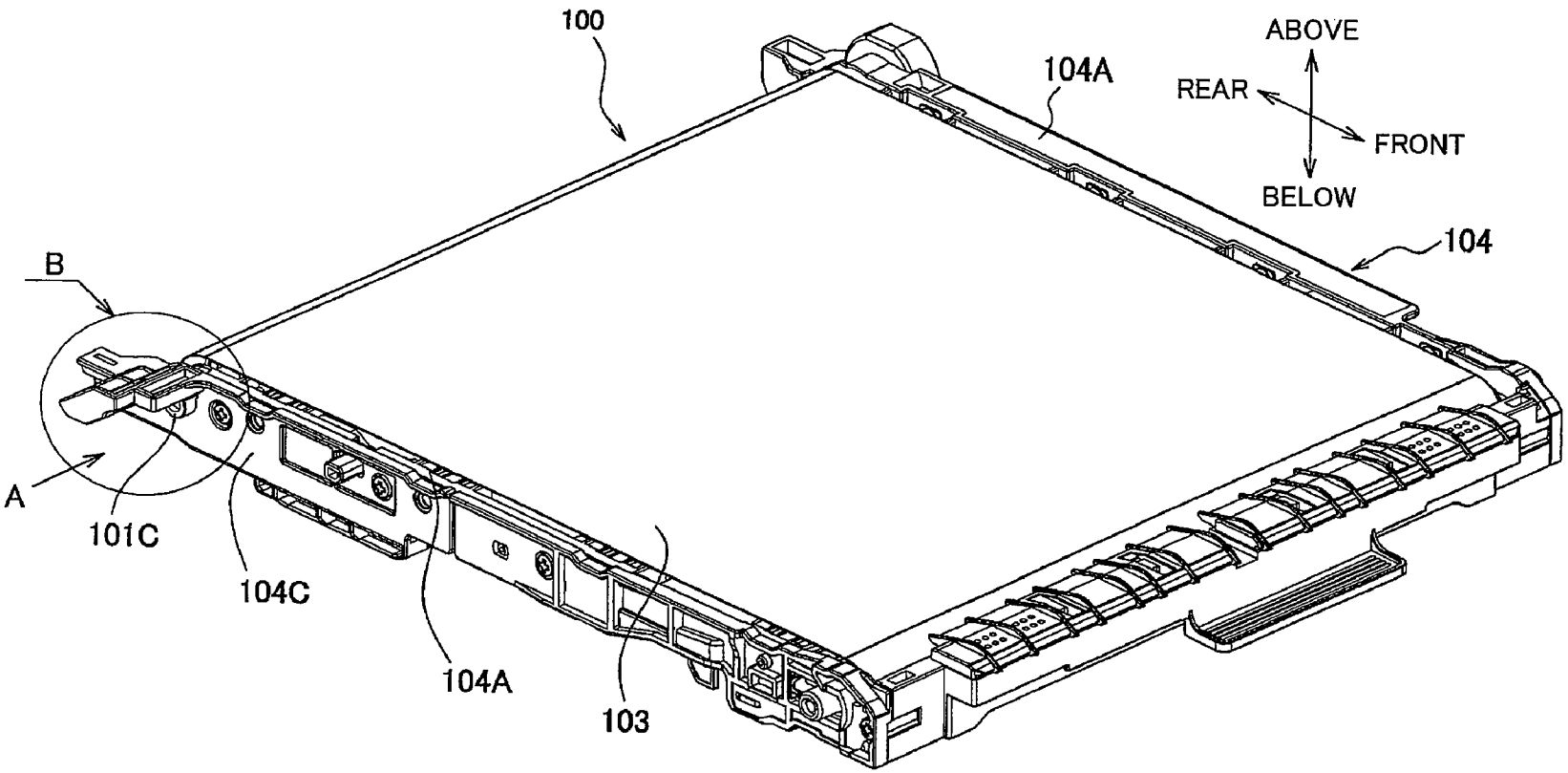
FIG. 2 is a perspective view of a belt unit according to the first embodiment.
Figure 4:
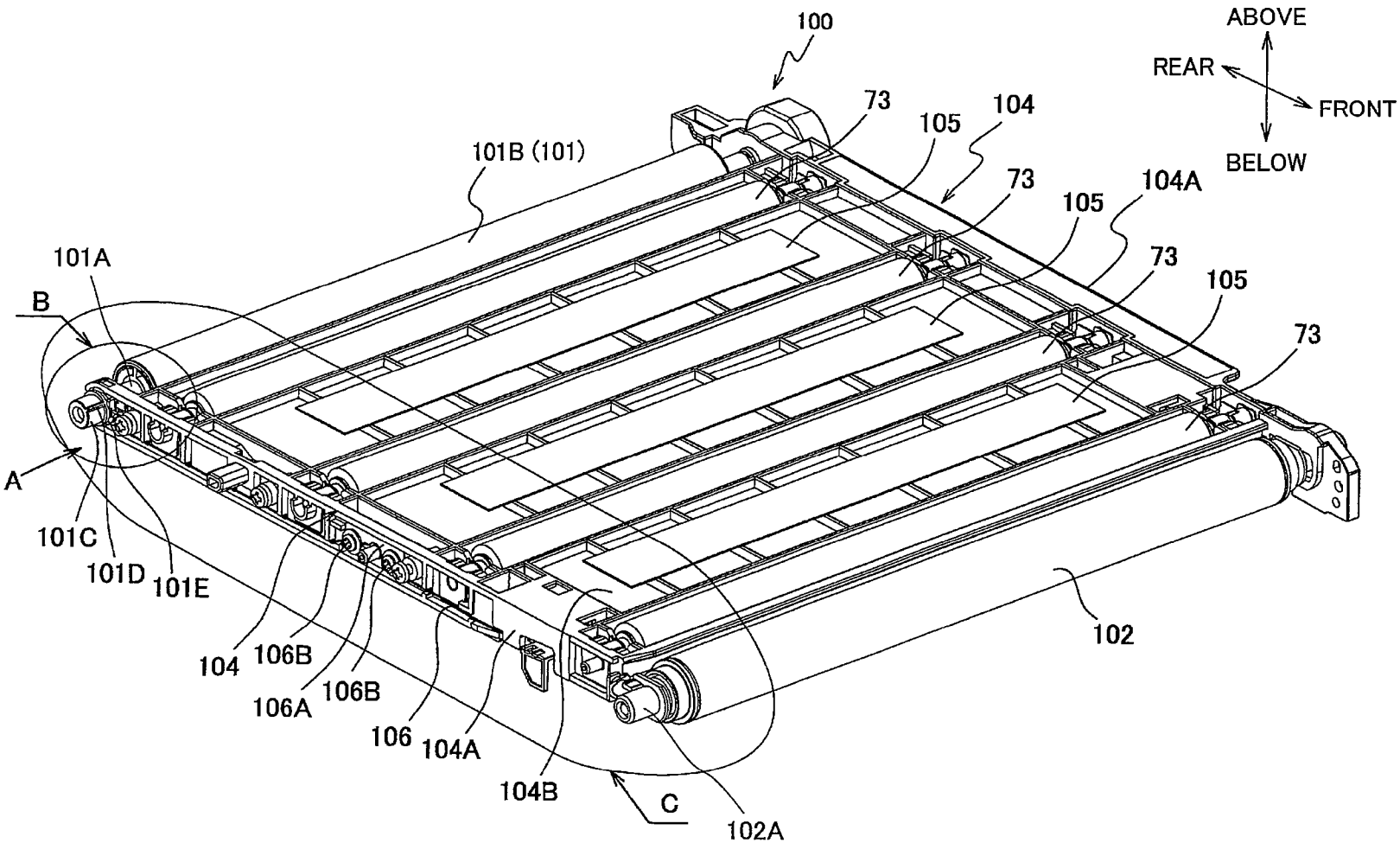
FIG. 4 is a perspective view showing the belt unit according to the first embodiment when a conveying belt has been removed.

The belt unit 100 is detachably mounted in the housing 3. As shown in FIG. 4, the belt unit 100 includes a driving roller 101 that rotates in conjunction with the operation of the image forming unit 10, a tension roller 102 rotatably disposed in space-apart relation with the driving roller 101, a conveying belt 103 (see FIG. 2), transferring rollers 73, a backup roller 124 (see FIG. 8), and a belt unit flame 104. The conveying belt 103 (see FIG. 2) is wrapped around the driving roller 101 and the tension roller 102, i.e., supported between the driving roller 101 and the tension roller 102.

The belt unit frame 104 is configured of side frames 104A extending in a direction orthogonal to the axial direction of the driving roller 101 for supporting both ends of rotational shafts 101A and 102A of the driving roller 101 and tension roller 102, respectively; a bridge part 104B extending parallel to the axis of the driving roller 101 for bridging the side frames 104A; and a frame cover 104C for covering the side frames 104A. The side frames 104A and bridge part 104B are integrally molded from a resin having excellent mechanical strength. Further, a groove 104D (see FIG. 3) is formed in the frame cover 104C concentric with the rotational shaft 101A of the driving roller 101.

The tension roller 102 is mounted in the belt unit frame 104 so as to be displaceable in a direction away from the driving roller 101. Bearings formed of resin are mounted on the shaft ends of the tension roller 102. When the belt unit 100 is mounted in the housing 3, the tension roller 102 receives the elastic force of a spring or other elastic means (not shown), pushing the tension roller 102 in the direction away from the driving roller 101. In this way, the tension roller 102 applies a prescribed tension to the conveying belt 103. The conveying belt 103 moves circularly along with the rotation of the driving roller 101 for conveying paper toward the fixing unit 80.

As shown in FIGS. 1 and 4, a plurality (four in the preferred embodiment) of the transferring rollers 73 are arranged at substantially equal intervals between the driving roller 101 and tension roller 102. When the belt unit 100 is mounted in the housing 3, the transferring rollers 73 are disposed in opposition to the photosensitive drums 71 on the opposite side of the conveying belt 103, as shown in FIG. 1. In other words, the transferring rollers 73 are disposed in confrontation with the photosensitive drums 71 with the area of the endless belt interposed therebetween.

The transferring rollers 73 rotate in association with the circular movement of the conveying belt 103. As a sheet of paper passes near the photosensitive drums 71, the transferring rollers 73 apply a voltage of opposite polarity to that of the photosensitive drums 71 (the charge carried by the developer) to the surface of the paper opposite the printing surface, thereby transferring developer carried on the surfaces of the photosensitive drums 71 to the printing surface of the paper or to the conveying belt 103.

An optical density sensor 94 is also disposed near the driving roller 101 for detecting the amount (density) of developer deposited on the area of the conveying belt 103. In the preferred embodiment, the density sensor 94 is disposed in confrontation with the driving roller 101 through the conveying belt 103. In other words, the density sensor 94 is disposed in confrontation with the conveying belt 103 and detects the density of developer deposited on the conveying belt 103. More specifically, the density sensor 94 reads a test pattern on the conveying belt 103 for adjusting the density of developer formed on the conveying belt 103 in a test mode. The test mode is a mode in which the transferring rollers 73 transfer developer image to the conveying belt 103.

Figure 5:
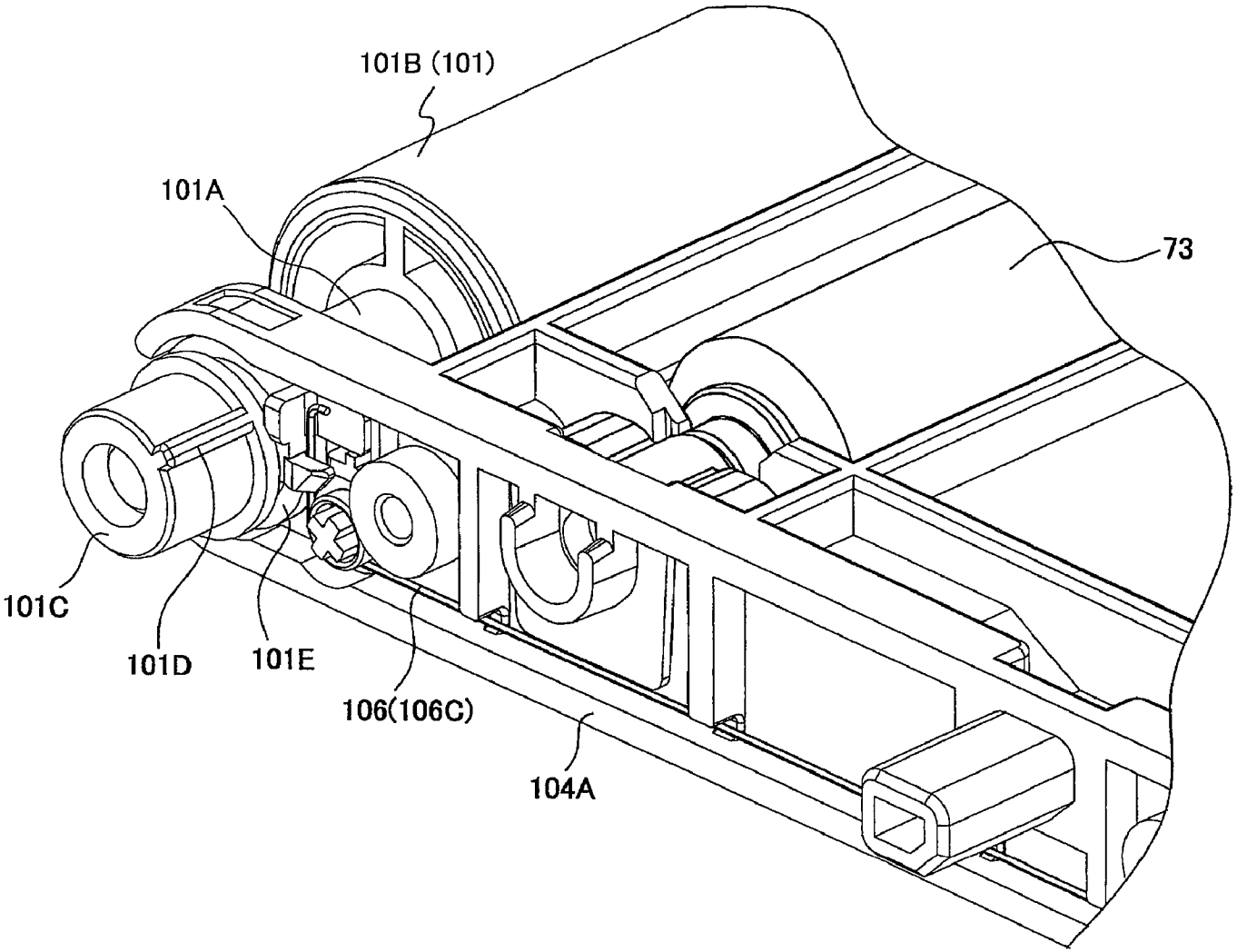
FIG. 5 is an enlarged view of a section B shown in FIG. 4.
Figure 6:
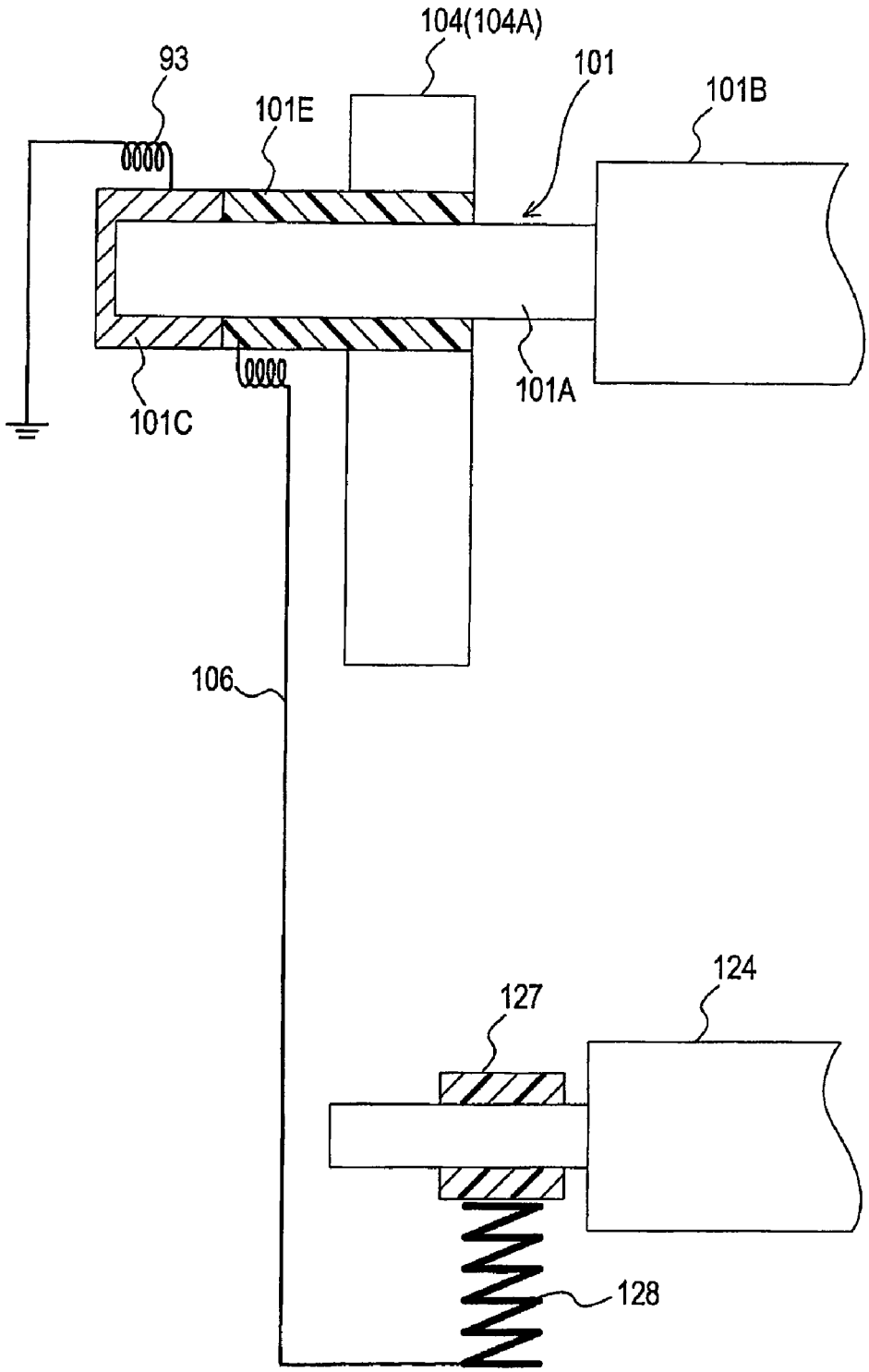
FIG. 6 is an explanatory diagram illustrating a grounding circuit according to the first embodiment.

As shown in FIGS. 5 and 6 the driving roller 101 has the rotational shaft 101A formed of a metal, such as stainless steel or iron, and a resin layer 101B formed of a resin having a high coefficient of friction, such as rubber or urethane, and disposed around the peripheral surface of the rotational shaft 101A in a region corresponding to the conveying belt 103 (see FIG. 1).

The rotational shaft 101A is rotatably supported in the side frames 104A via sliding bearings 101E formed of an electrically conductive resin having a prescribed electrical resistance.

A cap 101C formed of metal (brass in the preferred embodiment) is provided on one axial end of the rotational shaft 101A for covering the end portion of the same. The inner peripheral surface of the cap 101C slidably contacts the outer peripheral surface of the rotational shaft 101A.

Figure 3:
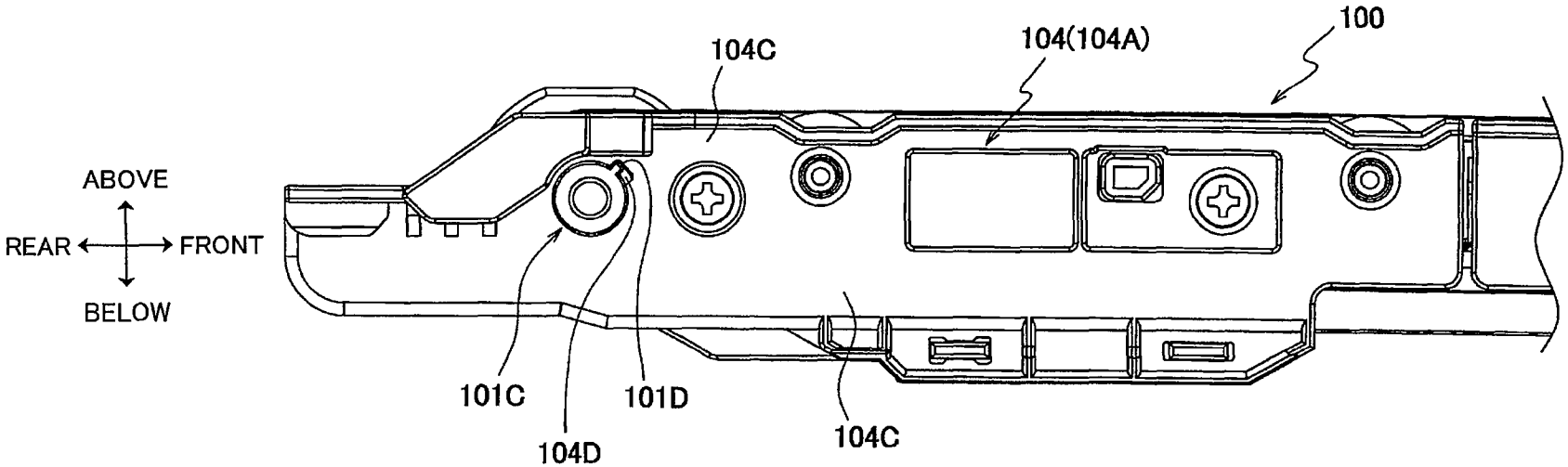
FIG. 3 is an enlarged view of a region B shown in FIG. 2 from a perspective along a direction indicated by an arrow A.

As shown in FIG. 3, a stopper 101D protrudes radially outward from the outer peripheral surface of the cap 101C. The stopper 101D is engaged in the groove 104D formed in the frame cover 104C to prevent the cap 101C from rotating together with the rotational shaft 101A so that the cap 101C is in a fixed state and does not rotate relative to the frame cover 104C. In the other words, the cap 101C is held stationary regardless of rotation of the rotational shaft 101A of the driving roller 101.

When the belt unit 100 is mounted in the housing 3, the ground connector 93 in a coiled state contacts the outer periphery of the cap 101C, as shown in FIG. 6. In other words, the ground connector 93 has a coil spring section. The ground connector 93 is urged against the cap 101C with urging force of the coil spring section.

Figure 7:
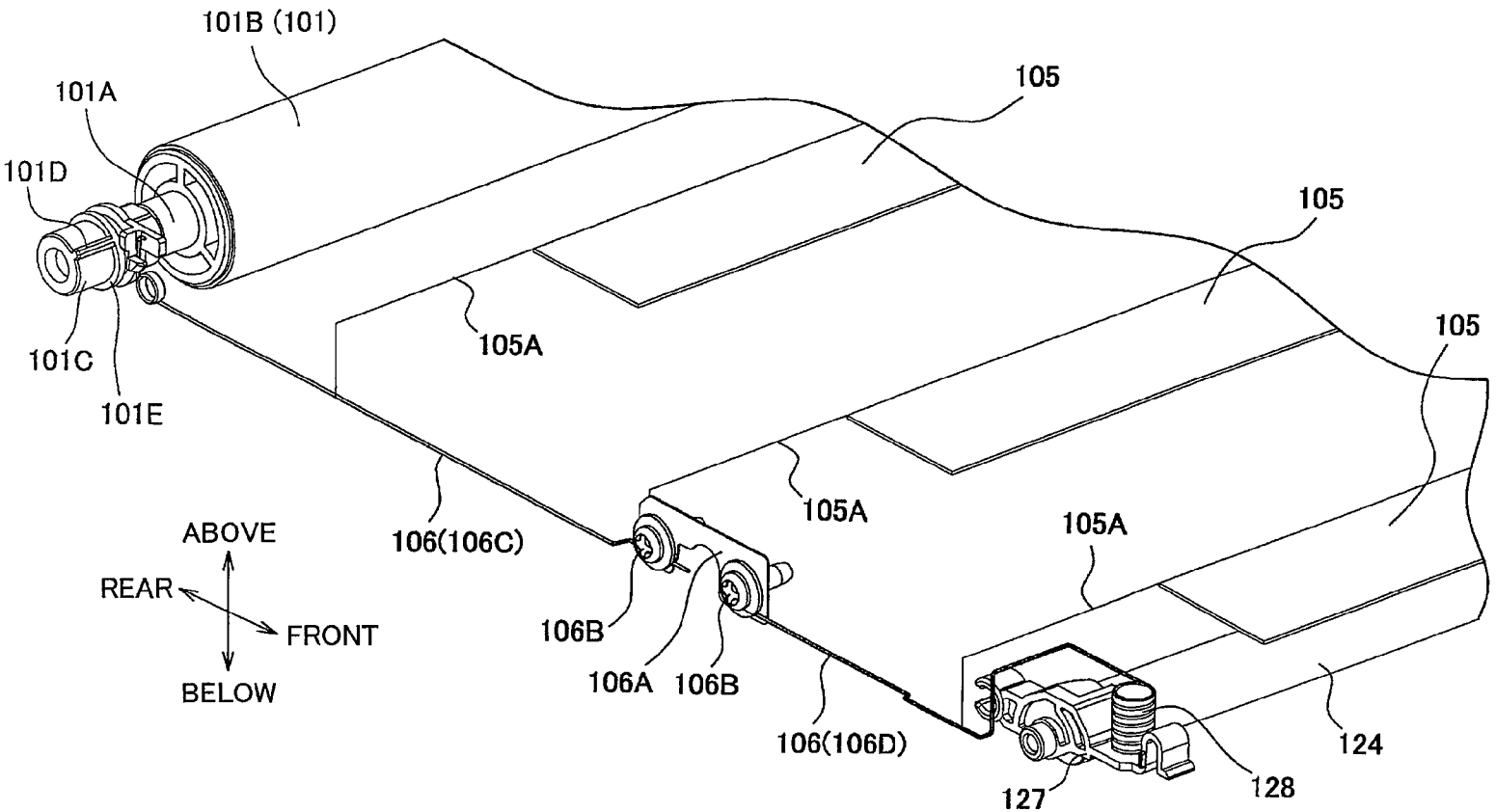
FIG. 7 is a partial perspective view illustrating the mounted state of the grounding circuit.

As shown in FIG. 4, neutralizing plates 105 formed of metal (stainless steel or copper in the preferred embodiment) are disposed between adjacent transferring rollers 73 of the belt unit 100 for removing the charge carried by the conveying belt 103 and the like. The neutralizing plates 105 are disposed between the tension roller 102 and the driving roller 101 such that each neutralizing plate 105 is interposed between adjacent two transferring rollers 73. As shown in FIG. 7, each of the neutralizing plates 105 is electrically connected to a connecting wire 106 described later via a connecting wire 105A. An electrode member (not shown) is also provided on the belt unit 100 extending in the displacement direction of the tension roller 102 for contacting the resin bearings mounted on the shaft ends of the tension roller 102. The electrode member is electrically connected to the cap 101C.

As shown in FIG. 1, the belt cleaner 120 is disposed below the belt unit 100. The belt cleaner 120 functions to remove developer from the surface of the conveying belt 103. The belt cleaner 120 is configured of a cleaning roller 121, a cleaning shaft 122, a waste developer collecting unit 123, the backup roller 124, a scraping blade 125, and a waste developer feed pump mechanism 126.

The cleaning roller 121 contacts the conveying belt 103 while rotating in the direction opposite the movement of the conveying belt 103. In this way, the cleaning roller 121 removes developer deposited on the conveying belt 103 by scraping the developer off the same.

The cleaning shaft 122 rotates while in contact with the outer surface of the cleaning roller 121. At this time, a voltage of opposite polarity to the charge carried by the developer is applied to the cleaning shaft 122, transferring the developer from the surface of the cleaning roller 121 to the cleaning shaft 122, thereby removing the waste developer from the cleaning roller 121.

The scraping blade 125 is a thin blade configured to scrape off waste developer transferred to the surface of the cleaning shaft 122. Subsequently, the waste developer feed pump mechanism 126 conveys the waste developer scraped off by the scraping blade 125 to the waste developer-collecting unit 123.

Figure 8:
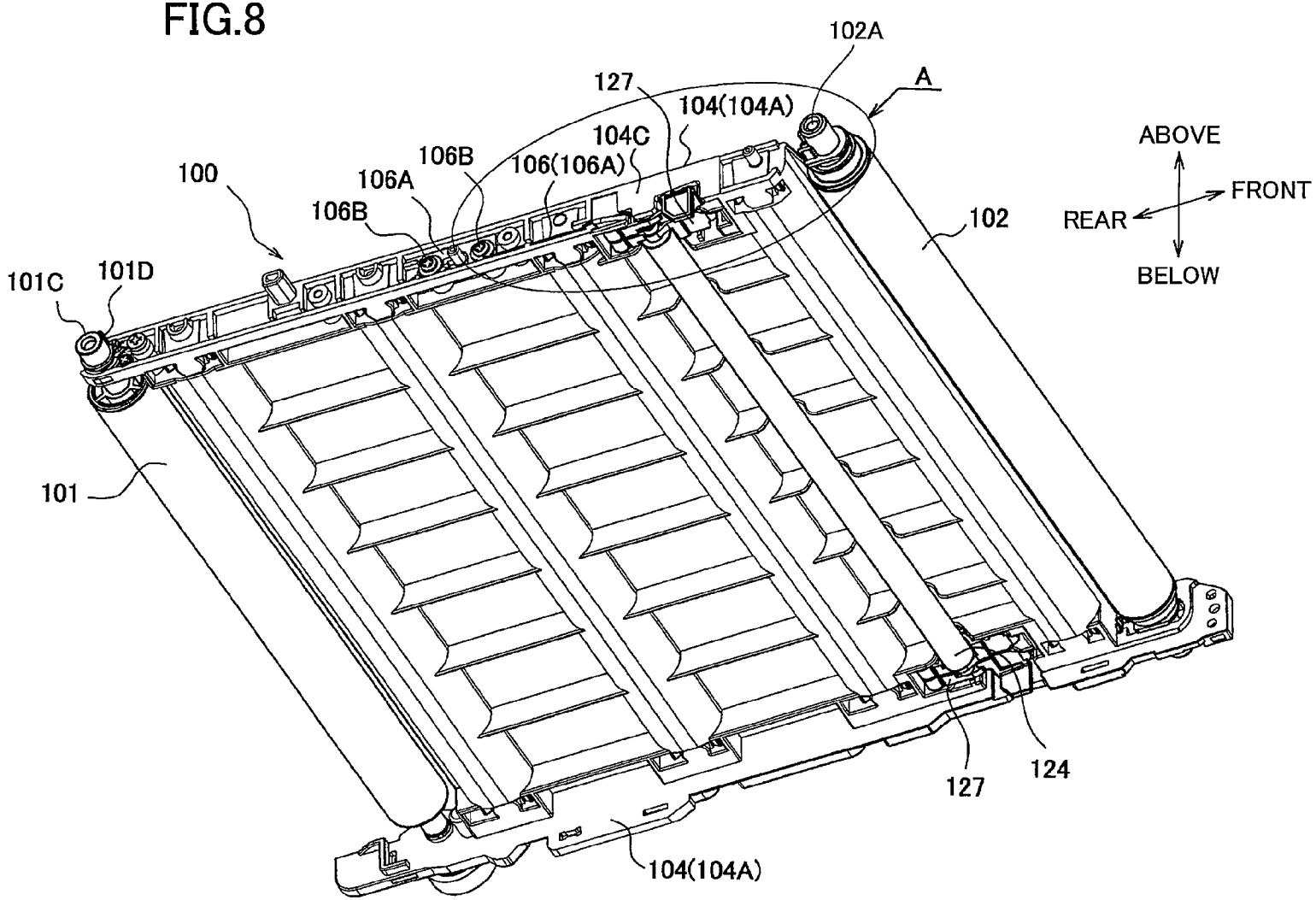
FIG. 8 is a perspective view from the bottom of the belt unit according to the preferred embodiment when the conveying belt has been removed.
Figure 9:
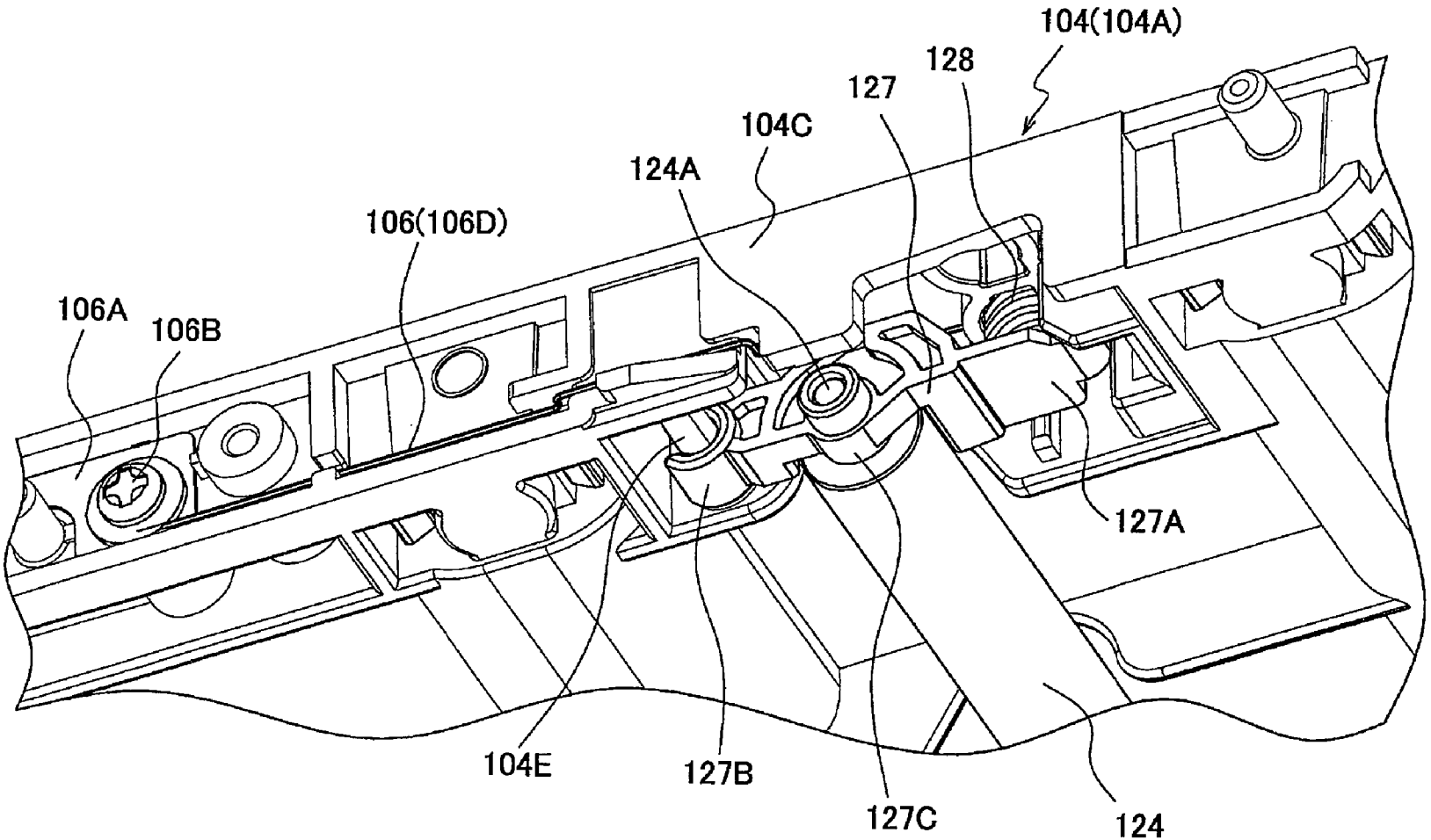
FIG. 9 is an enlarged view of a section A shown in FIG. 8.

As shown in FIGS. 6, 8, and 9, the backup roller 124 is rotatably mounted on the belt unit frame 104 through sliding bearings 127 formed of an electrically conductive resin. More specifically, the backup roller 124 has a shaft 124A that is rotatably supported in bearing parts 127C of the sliding bearings 127. Metal compression springs 128 generate an elastic force for urging the sliding bearings 127 toward the cleaning roller 121. In other words, the backup roller 124 is in peripheral contact with the cleaning roller 123. The backup roller 124 is electrically connected to the compression spring 128 through the sliding bearings 127.

As shown in FIG. 9, each of the sliding bearings 127 has a lever configuration with a first longitudinal end 127B pivotably coupled with a pivoting shaft 104E of the belt unit frame 104, and a second longitudinal end 127A positioned on the opposite side of the backup roller 124 from the pivoting shaft 104E. The elastic force of the compression spring 128 is applied to the second longitudinal end 127A of the sliding bearing 127 to urge the backup roller 124 toward the cleaning roller 121.

As shown in FIGS. 6 and 7, one end of the compression spring 128 constitutes part of the connecting wire 106 (connecting wire 106D) that extends toward the driving roller 101 side. The connecting wire 106 is electrically connected to the backup roller 124 via the sliding bearing 127.

As shown in FIG. 7, the connecting wire 106 is configured of a connecting wire 106C on the driving roller 101 side, the connecting wire 106D on the backup roller 124 side, and a connecting plate 106A electrically connecting the connecting wires 106C and 106D. More specifically, the connecting wires 106C and 106D are fixed to the connecting plate 106A by metal plus screws 106B. The connecting wires 106C and 106D are formed of metal wire having elasticity, such as a steel spring material.

The driving roller 101 end of the connecting wire 106C is twisted in a coil shape that contacts and is electrically connected to the outer peripheral surface of the sliding bearing 101E. The connecting wire 106C also applies an elastic force to the outer peripheral surface of the sliding bearing 101E. With this construction, the neutralizing plates 105, backup roller 124, and other neutralization targets are electrically connected to the rotational shaft 101A via the connecting wire 106 and sliding bearing 101E. As described above, the rotational shaft 101A is connected to a ground connector 93 via the cap 101C and grounded by the ground connector 93. The ground connector 93 is provided on the frame member of the housing 3. The ground connector 93 is a metal wire having elasticity that is twisted into a coil spring shape, such as a steel spring member, and is grounded.

In the construction described above, the sliding bearing 101E is electrically connected between the neutralizing plates 105 and backup roller 124 and the cap 101C having a prescribed electrical resistance, while the rotational shaft 101A of the driving roller 101 is electrically connected to the cap 101C through the sliding bearing 101E. Therefore, the electrical resistance between the driving roller 101 and the cap 101C is less than that between the neutralizing plates 105 (the conveying belt 103) and the cap 101C. For example, the electrical resistance between the driving roller 101 and the cap 101C is several ohms, while the electrical resistance between the neutralizing plates 105 (the conveying belt 103) and the cap 101C is several thousand ohms. By the same token, the electrical resistance between the driving roller 101 and the cap 101C is less than that between the backup roller 124 and the cap 101C. And, the electrical resistance between the driving roller 101 and the cap 101C is less than that between the tension roller 102 and the cap 101C.

Hence, an electrical charge is quickly removed from the driving roller 101 and more gradually removed from the neutralizing plates 105 (the conveying belt 103), the tension roller 102, and the backup roller 124, thereby simultaneously preventing adverse effects on image formation and adverse effects on the density sensor 94 disposed near the driving roller 101.

Since the belt unit 100 is detachably mounted in the housing 3, it is preferable to minimize the number of electrical contacts between the belt unit 100 and the body of the laser printer 1.

To achieve this, the driving roller 101 and the tension roller 102, neutralizing plates 105, and backup roller 124 are all connected to the ground connector 93 in the housing 3 through the cap 101C. In other words, the cap 101C is connected between the ground connector 93 and the driving roller 101, the tension roller 102, the backup roller, and the neutralizing plates 105 (the conveying belt 103). Accordingly, this construction reduces the number of electrical contacts between the belt unit 100 and housing 3.

Further, although the rotational shaft 101A of the 101 is formed of metal, the resin layer 101B is provided on the portion of the rotational shaft 101A corresponding to the conveying belt 103. Formed of a resin, such as rubber or urethane, the resin layer 101B functions as an electric-resistive material.

Hence, when a transfer bias is applied to the transferring rollers 73, this construction prevents an excessive charge migrating from the driving roller 101 toward the ground connector 93 side via the conveying belt 103, thereby preventing adverse effects on image formation. However, the charge retained by the metal rotational shaft 101A of the driving roller 101 migrates quickly to the ground connector 93 via the cap 101C, thereby suppressing adverse effects on the ground connector 93.

Further, since the sliding bearing 101E also functions as a grounding resistance member for the second neutralization targets, it is not necessary to provide a separate electric-resistive material for this purpose, thereby simplifying the structure of the belt unit 100.

Since the belt unit 100 is detachably mounted in the housing 3, there is potential for the contact point between the cap 101C and the ground connector 93 to become misaligned. If the cap 101C and the ground connector 93 were configured to form a sliding contact, there is great risk that this contact point would be unstable.

To avoid this, a unit-side ground connector electrically connected to the ground connector 93 is configured of the cap 101C that slidably contacts the outer peripheral surface of the rotational shaft 101A. Further, since the cap 101C contacts the ground connector 93 in a fixed state, without rotation or displacement relative to the ground connector 93, the ground connector 93 and the cap 101C contact each other in a fixed state rather than a slidable state, thereby stabilizing the contact point between the cap 101C and the ground connector 93.

Further, the backup roller 124 is electrically connected to the cap 101C via the metal compression spring 128 electrically connected to the backup roller 124, thereby simplifying the structure of the belt unit 100.

The present invention is not particularly limited to the contact structure described in the preferred embodiment for supplying a transfer bias from the laser printer 1 to the transferring rollers 73. For example, the following structure shown in FIG. 10 may be employed.

Figure 10:
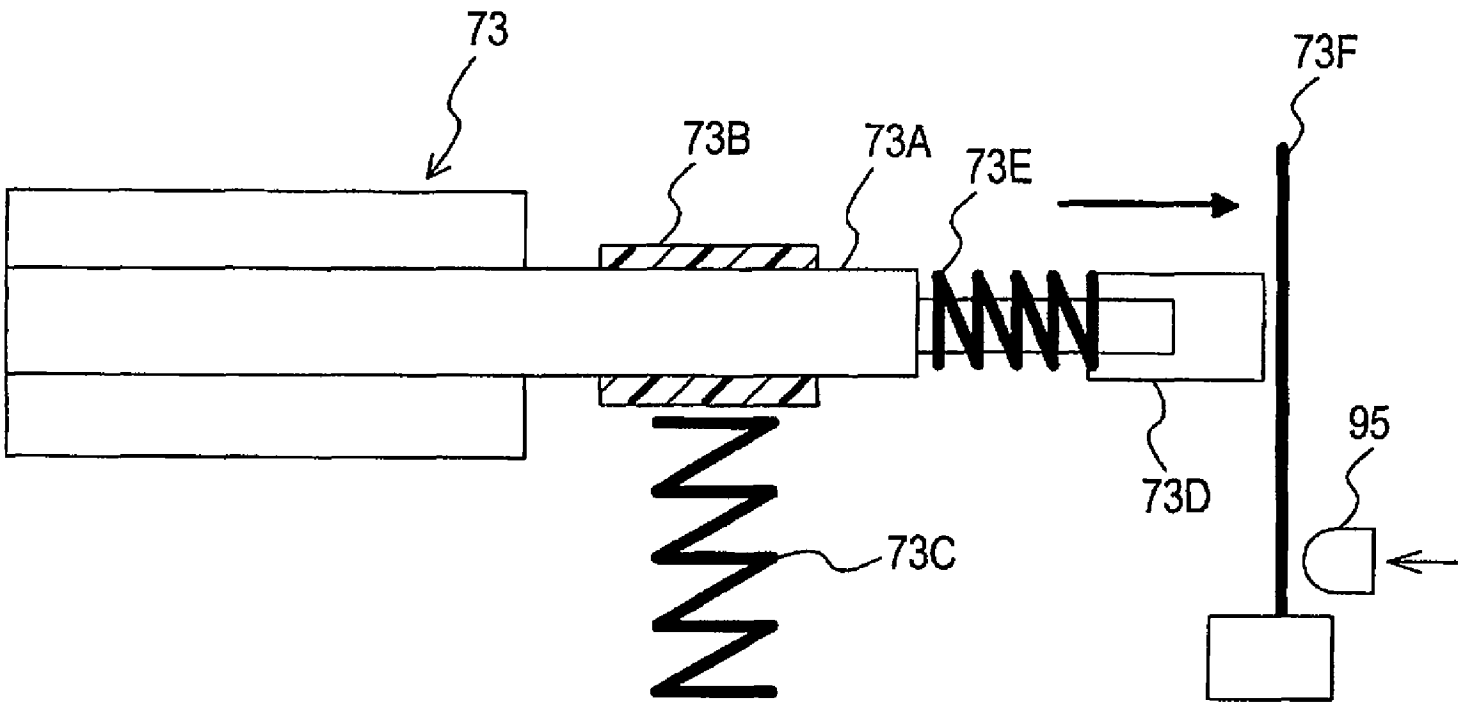
FIG. 10 is an explanatory diagram illustrating a contact structure according to a second embodiment of the present invention.

As shown in FIG. 10, each of the transferring rollers 73 has a metal shaft 73A rotatably supported in sliding bearings 73B. Coil springs 73C urge the sliding bearings 73B toward the conveying belt 103 (upward toward the photosensitive drum 71).

A cap 73D formed of a conductive resin is mounted over the outer surface of the shaft 73A on an axial end thereof. The cap 73D is capable of sliding over the outer peripheral surface of the shaft 73A to be displaced relative to the shaft 73A in the axial direction. A coil spring 73E or other elastic means is provided for urging the cap 73D toward a contact point 73F on the body of the belt unit in the axial direction of the shaft 73A.

A main body transfer bias contact point 95 provided on the main body of the laser printer 1 is urged toward the contact point 73F for pressing the contact point 73F against the cap 73D to connect the two. In this way, a transfer bias can be applied to the transfer roller 73 through the transfer bias contact point 95.

With this construction, the contact point (cap 73D) on the transfer roller 73 side reliably contacts the contact point 73F, even when the elastic force of the coil spring 73C displaces the transfer roller 73. Accordingly, a transfer bias can be reliably provided to the transfer roller 73.

The application of the contact structure described above is not limited to the transfer roller 73, but may also be applied to other rollers having an electrical contact, such as the driving roller 101.

Further, while the laser printer 1 according to the preferred embodiment described above has the belt cleaner 120, the present invention is not limited to this structure and may be applied to an image-forming device without the belt cleaner 120.

Further, while the laser printer 1 according to the preferred embodiment described above has the neutralizing plates 105, the present invention is not limited to this construction. For example, the present invention may be applied to an image-forming device without the neutralizing plates 105 or to an image-forming device having neutralizing needles or brush in place of the neutralizing plates 105.

Further, while the preferred embodiment uses the tension roller 102, neutralizing plates 105, and the backup roller 124 as an example of the second neutralization targets, the present invention is not limited to these components.

Further, in the preferred embodiment, the backup roller 124 is electrically connected to the compression spring 128 via the sliding bearing 127, but the present invention is not limited to this construction. For example, part of the compression spring 128 may be twisted into a coil spring part that is directly connected to the backup roller 124.

Further, in the preferred embodiment described above, the cap 101C is provided on an axial end of the rotational shaft 101A, and the rotational shaft 101A is electrically connected to the ground connector 93 via the cap 101C, but the present invention is not limited to this construction. For example, the ground connector 93 may be directly connected to the rotational shaft 101A, eliminating the cap 101C.

Further, in the preferred embodiment described above, the unit-side ground connector is provided on an axial end of the rotational shaft 101A, but the present invention is not limited to this construction.

Further, in the preferred embodiment described above, the stopper 101D is engaged in the groove 104D formed in the frame cover 104C to fix the cap 101C so that the cap 101C does not rotate relative to the frame cover 104C (belt unit frame 104) and the like, but the present invention is not limited to this construction. For example, the cap 101C may be permanently fixed to the frame cover 104C.

Further, in the preferred embodiment described above, the present invention is applied to an image-forming device having a direct tandem system, but the present invention is not limited to this application and may be applied to an image-forming device having an intermediate transfer belt.

What is claimed is:

1. An image-forming device comprising:

a housing;

an image-carrying member that carries a developer image;

a conveying unit that comprises a driving roller having a rotation shaft to be rotatable thereabout, a tension roller disposed in spaced-apart relation with the driving roller, and an endless belt supported between the driving roller and the tension roller and moved circularly by the driving roller, the endless belt having an area in confrontation with the image-carrying member and conveying a recording sheet placed thereon;

a transferring unit that is disposed in confrontation with the image-carrying member with the area of the endless belt interposed therebetween and configured to transfer the developer image on the image-carrying member to the endless belt in a first mode and to the recording sheet placed on the endless belt in a second mode;

an optical sensor that is disposed near the driving roller and operable in the first mode to detect the developer image on the endless belt;

a ground connector that is electrically grounded;

a first connection member that has a first electrical resistance and is connected between the driving roller and the ground connector to allow electrical charges to flow therebetween; and a second connection member that has a second electrical resistance and is connected between the endless belt and ground connector to allow electrical charges to flow therebetween, the first electrical resistance being less than the second electrical resistance.

2. The image-forming device according to claim 1, wherein the conveying unit is detachably disposed in the housing.

3. The image-forming device according to claim 1, wherein the second connection member is connected between the ground connector and the tension roller to allow electrical charges to flow therebetween.

4. The image-forming device according to claim 1, further comprising a relaying member that is attached to the driving roller, wherein both the first connection member and the second connection member are connected to the ground connector via the relaying member.

5. The image-forming device according to claim 4, wherein the first connection member is coupled to the rotation shaft having an end portion, and the second connection member has a bearing that supports the rotation shaft of the driving roller, the bearing having a third electrical resistance and being electrically connected to the relaying member.

6. The image-forming device according to claim 5, wherein the relaying member slidably contacts the end portion of the rotation shaft of the driving roller and is held stationary regardless of rotation of the driving roller.

7. The image-forming device according to claim 5, wherein the rotation shaft is formed of a metal, and the bearing is formed of a conductive resin.

8. The image-forming device according to claim 5, wherein the relaying member comprises a metal cap covering the end potion of the rotation shaft.

9. The image-forming device according to claim 4, wherein the ground connector has a coil spring section, the ground connector being urged against the relaying member with urging force of the coil spring section.

10. The image-forming device according to claim 1, wherein the transferring unit comprises a plurality of transferring rollers that are juxtaposed between the driving roller and the tension roller, and the second connection member comprises a plurality of electrically conductive plates disposed between the tension roller and the driving roller such that each electrically conductive plate is interposed between adjacent two transferring rollers, and wherein the second connection member is connected between the ground connector and the electrically conductive plate to allow electrical charges to flow therebetween.

11. The image-forming device according to claim 10, wherein the second connection member comprises a metal wire that is connected between the electrically conductive plate and the relaying member to allow electrical charges to flow therebetween.

12. The image-forming device according to claim 1, further comprising a cleaning roller that removes developer on the endless belt, and a backup roller that is in peripheral contact with the cleaning roller, wherein the second connection member is connected between the ground connector and the backup roller to allow electrical charges to flow therebetween.

13. The image-forming device according to claim 12, wherein the second connection member comprises a metal spring that urges the backup roller toward the cleaning roller, the metal spring being electrically connected between the backup roller and the relaying member to allow electrical charges to flow therebetween.

14. The image-forming device according to claim 1, wherein the second electrically resistance is thousand times as large as the first electrically resistance.

15. An image-forming device comprising:

a housing;

an image-carrying member that carries a developer image;

a conveying unit that comprises a driving roller having a rotation shaft to be rotatable thereabout, a tension roller disposed in spaced-apart relation with the driving roller, and an endless belt supported between the driving roller and the tension roller and moved circularly by the driving roller, the endless belt having an area in confrontation with the image-carrying member and conveying a recording sheet placed thereon;

a transferring unit that is disposed in confrontation with the image-carrying member with the area of the endless belt interposed therebetween and configured to transfer the developer image on the image-carrying member to the endless belt in a first mode and to the recording sheet placed on the endless belt in a second mode;

an optical sensor that is disposed near the driving roller and operable in the first mode to detect the developer image on the endless belt;

a cleaning unit that comprises a cleaning roller that removes the developer on the endless belt, and a backup roller that is in peripheral contact with the cleaning roller;

a ground connector that is electrically grounded;

a first connection member that has a first electrical resistance and is connected between the driving roller and the ground connector to allow electrical charges to flow therebetween; and a second connection member that has a second electrical resistance and is connected between the ground connector and at least one selected from a group consisting of the endless belt, the tension roller, and the backup roller, to allow electrical charges to flow therebetween, the first electrical resistance being less than the second electrical resistance.

16. The image-forming device according to claim 15, wherein the conveying unit is detachably disposed in the housing.

17. The image-forming device according to claim 15, further comprising a relaying member that is attached to the driving roller, wherein both the first connection member and the second connection member are connected to the ground connector via the relaying member.

18. The image-forming device according to claim 17, wherein the first connection member is coupled to the rotation shaft having an end portion, and the second connection member has a bearing that supports the rotation shaft of the driving roller, the bearing having a third electrical resistance and being electrically connected to the relaying member.

19. The image-forming device according to claim 18, wherein the relaying member slidably contacts the end portion of the rotation shaft of the driving roller and is held stationary regardless of rotation of the driving roller.

20. The image-forming device according to claim 18, wherein the rotation shaft is formed of a metal, and the bearing is formed of a conductive resin.

21. The image-forming device according to claim 18, wherein the relaying member comprises a metal cap covering the end potion of the rotation shaft.

22. The image-forming device according to claim 17, wherein the ground connector has a coil spring section, the ground connector being urged against the relaying member with urging force of the coil spring section.

23. The image-forming device according to claim 15, wherein the transferring unit comprises a plurality of transferring rollers that are juxtaposed between the driving roller and the tension roller, and the second connection member comprises a plurality of electrically conductive plates disposed between the tension roller and the driving roller such that each electrically conductive plate is interposed between adjacent two transferring rollers, and wherein the second connection member is connected between the ground connector and the electrically conductive plate to allow electrical charges to flow therebetween.

24. The image-forming device according to claim 23, wherein the second connection member comprises a metal wire that is connected between the electrically conductive plate and the relaying member to allow electrical charges to flow therebetween.

25. The image-forming device according to claim 17, wherein the second connection member comprises a metal spring that urges the backup roller toward the cleaning roller, the metal spring being electrically connected between the backup roller and the relaying member to allow electrical charges to flow therebetween.

26. The image-forming device according to claim 15, wherein the second electrically resistance is thousand times as large as the first electrically resistance.

* * * * *